United States Patent [19]

Demmers

[11] 4,261,275

[45] Apr. 14, 1981

[54] HOPPER BARGE

[75] Inventor: Arie A. Demmers, Alblasserdam, Netherlands

[73] Assignee: Koninklijke Bos Kalis Westminster Group N.V., Sliedrecht, Netherlands

[21] Appl. No.: 60,163

[22] Filed: Jul. 24, 1979

[30] Foreign Application Priority Data

Jul. 28, 1978 [NL] Netherlands ..... 7808014

[51] Int. Cl.[3] ..... B63B 35/30

[52] U.S. Cl. ..... 114/29; 60/420; 60/426

[58] Field of Search ..... 114/27, 28, 29, 30; 105/262, 263, 240; 298/25; 60/420, 426

[56] References Cited

U.S. PATENT DOCUMENTS 3,401,661 9/1968 Van der Werff ..... 114/29

FOREIGN PATENT DOCUMENTS 2,341,244 3/1974 Fed. Rep. of Germany ..... 114/29

485,906 12/1975 U.S.S.R. ..... 114/28

*Primary Examiner*—Sherman D. Basinger

*Attorney, Agent, or Firm*—Cushman, Darby & Cushman

[57] ABSTRACT

A hopper barge having at least two longitudinal air chambers interconnected pivotally at deck level, which chambers in a loading position bound an upwardly open well and in an unloading position release a discharge opening at the bottom, and comprising at least one control unit for controlling the relative position of the air chambers, with per each control unit two synchronously controlled jack means, which are each pivotally connected with at least one of the air chambers by on the one end a lever arm, which two lever arms are arranged in substantially mirror-symmetrical relationship relative to the median longitudinal plane of the vessel and being interconnected pivotally, and on the other end a hinge fixedly secured to one of the air chambers.

8 Claims, 10 Drawing Figures

Figure 3:
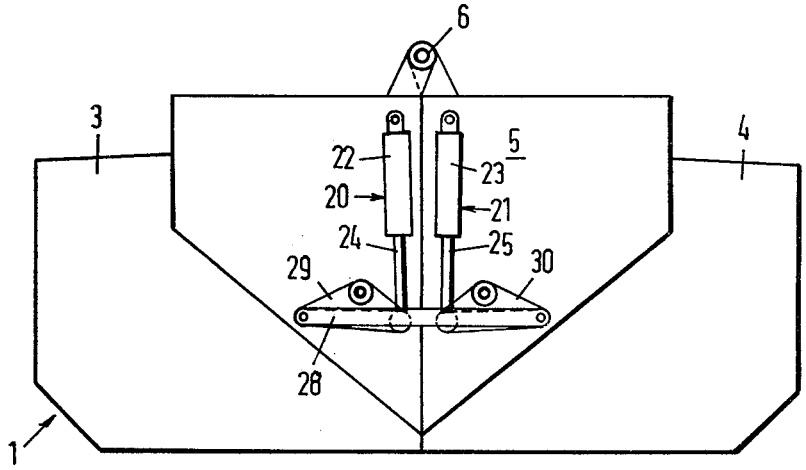

FIG.1
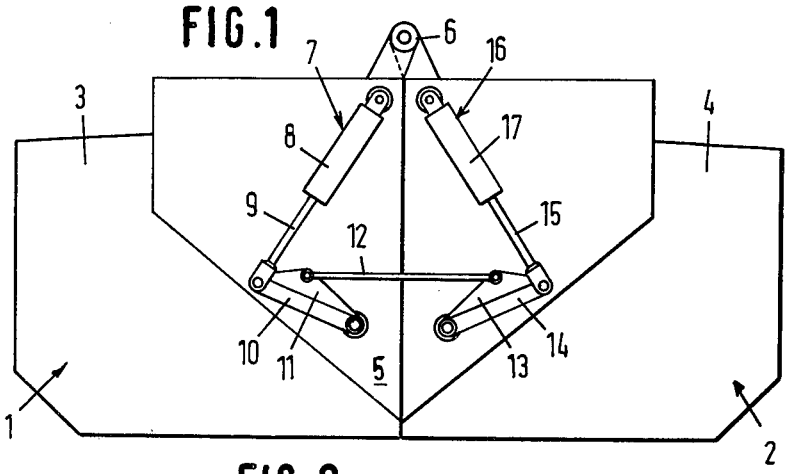
FIG.2
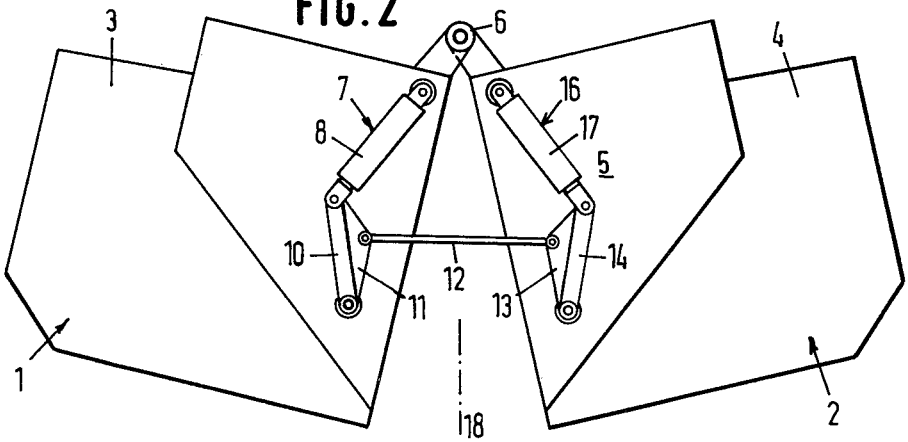
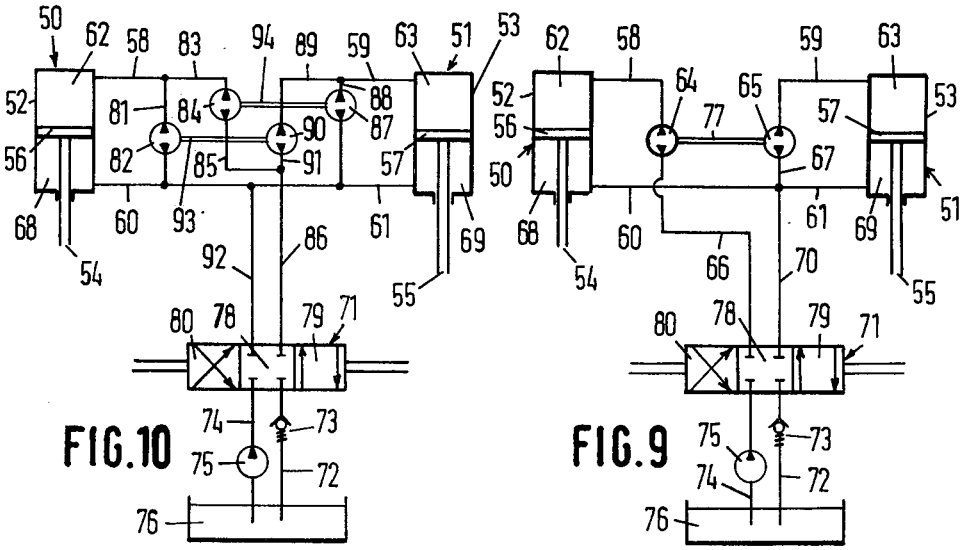
FIG.10
FIG.9

HOPPER BARGE

The invention relates to a hopper barge provided with at least two longitudinal air chambers pivotally interconnected at deck height, which air chambers in a loading position define an upwardly open well and in an unloading position release an unloading opening situated substantially at the bottom, as well as at least one control unit for controlling the mutual position of the air chambers comprising at least one jack means and at least two lever arms, each jack means being pivoted through a lever arm to one of the air chambers and the lever arms being arranged substantially in mirror-symmetrical relationship relative to the median longitudinal plane of the vessel and mutually coupled pivotally.

The hopper barge having such a control unit is known from Dutch patent application No. 7,211,409. The opening and closing mechanism consists of a substantially horizontal hydraulic cylinder positioned transversely to the vessel, which cylinder is connected to both air chambers via two lever constructions that are mutually coupled pivotally. A drawback going with such a construction is that if the rather robust hydraulic cylinders are positioned on the upper deck, in particular in case of larger vessels, these have such dimensions as to occupy a substantial part of the remaining effective deck space, to which should be added that the cylinders constitute a substantial obstacle as a result of a transverse positioning. In particular these cylinders, however, should be adapted to take up substantial bending and buckling loads and have a heavy construction accordingly. Further problems arise as a result of the fact that the cylinders have no single fixed point relative to the vessel, so that the connection of hydraulic lines entails difficulties.

Besides hopper barges are known wherein the control unit for controlling the interspace of the air chambers pivotally connected at deck height comprises a hydraulic cylinder which lies a certain distance under deck and is coupled at the ends directly pivotally to both air chambers. This construction has the drawback, that the cylinder has to be conducted through both vertical adjoining interfaces of the two air chambers. This constructive problem is considerably increased in that the cylinder during the extension and retraction also executes as a whole a displacement in vertical direction, so that the protection of the cylinder by means of rubber or stainless steel elements is considerably impeded. Furthermore such a cylinder can be difficultly mounted and demounted.

It is the object of the present invention to provide a construction wherein the above described drawbacks are inexistent and wherein comparatively lighter means, which moreover can be conveniently mounted and demounted, will suffice.

This is achieved in accordance with the invention in a hopper barge of the above described type if per each control unit two simultaneously controlled jack means are present which are each pivotally connected to at least one of the air chambers by on the one end a lever arm and on the other end a joint secured to one of the air chambers. The jack means to be positioned under deck need no longer project in this construction through the interfaces, however, a rod has to do this, since the construction now consisting substantially of two identical mechanisms should naturally be coupled mutually. The passage of a rod, however, can be realized rather simply from a constructive viewpoint. Through application of two jack means per each control unit, two simply mountable and demountable mechanisms are obtained with comparatively small and light jack means which are optimally utilized. Besides each mechanism may be accommodated in a substantially enclosed space, viz. in such a spot as to exclude obstacles.

In order to obtain an optimally effective and favourable transmission of forces, it is preferable according to a further embodiment of the invention that the joints of the jack means affixed to the air chambers are disposed adjacent the hinge joint between the two air chambers.

If it is ensured in accordance with a preferred embodiment of the invention that both jack means extend substantially in vertical direction, the bending loads exerted on the jack means will still further be reduced, which results in a still lighter construction.

In accordance with another embodiment of the invention it is preferable that each jack means is pivotally connected via a substantially triangular element to each time one of the two air chambers, while both triangular elements are pivoted to a connection rod by means of which an optimal transmission of forces can be achieved.

Upon application of two jack means it is recommendable that the displacements of the two jack means of a control unit are identical to each other. In a preferred embodiment of the invention this is advantageously effected in that the simultaneous control of the two piston-cylinder jack means each operated from a fluid is effected with a steering system provided with two hydraulic pump-motor units having directly coupled rotary shafts, whereby the one unit is incorporated in the flow path of the operating fluid of the one cylinder and the other unit in that of the other cylinder.

In order to realize the control as quickly as possible and with small, inexpensive units, it is preferable according to still another embodiment of the invention that two pairs of directly interconnected pump-motor units are present, whereby the first unit of the one pair is present in a forced circulation circuit of the first cylinder and the other in a supply-discharge path of the second cylinder, while the one unit of the other pair is disposed in a supply-discharge path of the first cylinder and the other in a forced circulation circuit of the second cylinder. As a result of this feature it is achieved besides a mimimal quantity of fluid to be displaced likewise that this quantity is moved over a minimal path. This effect may be improved yet when the pump-motor units are disposed in those lines wherein a pressure force prevails during the bringing of the vessel in the loading position.

Some embodiments of the invention will now be described, by way of example, with reference to the accompanying drawings, wherein:

FIG. 1 diagrammatically shows a cross-section of a hopper barge according to the invention in the closed loading position;

FIG. 2 the same vessel in the unloading position;

FIGS. 3–8 variants of the control unit according to FIGS. 1 and 2;

FIG. 9 a control system for simultaneously operating the jack means shown in FIGS. 1–8; and FIG. 10 a variant of the control system according to FIG. 9.

A hopper barge according to the invention comprises two halves 1 and 2 having air chambers 3 and 4 and formed therebetween a well 5. The two vessel halves are interconnected pivotally by a hinge 6 extending substantially adjacent the ship's deck.

The ship half 1 according to FIG. 1 is disposed in a hydraulic jack means 7 comprising a cylinder 8 and a piston rod 9, the free end of which is pivoted to the one end of a lever 10 whose other end is pivoted to the ship half 1. Similarly the bottom end of the cylinder 8 is pivotally connected to the ship half 1. On the lever 10 there is welded a triangular plate 11 in a plane perpendicular to the mutually parallel pins of the hinges at the ends of the lever 10. Adjacent the angular point of plate 11 not lying on lever 10, the one end of a connection rod 12 is pivotally secured to the plate 11. The other end of the connection rod 12 is similarly secured to a triangular plate 13 welded on a lever 14 which on the one end is pivoted to the ship half 2 and on the other end to a piston rod 15 of a jack means 16 which furthermore comprises a cylinder 17, the bottom end of which is pivoted to ship half 2. The arrangement of the elements 7–17 is such that these form a mirror-symmetrical construction relative to the longitudinal median plane of the vessel.

If the vessel is to be brought from the loading position shown in FIG. 1 in the unloading position shown in FIG. 2, this is effected by retracting the piston rods 9 and 15 in cylinders 8 and 17. Through these actions of the jack means 7 and 16 and the resulting operation of the linkage 10–14 the ship halves 1 and 2 will swivel away from each other, thus releasing a bottom-discharging opening 18.

Figure 4:
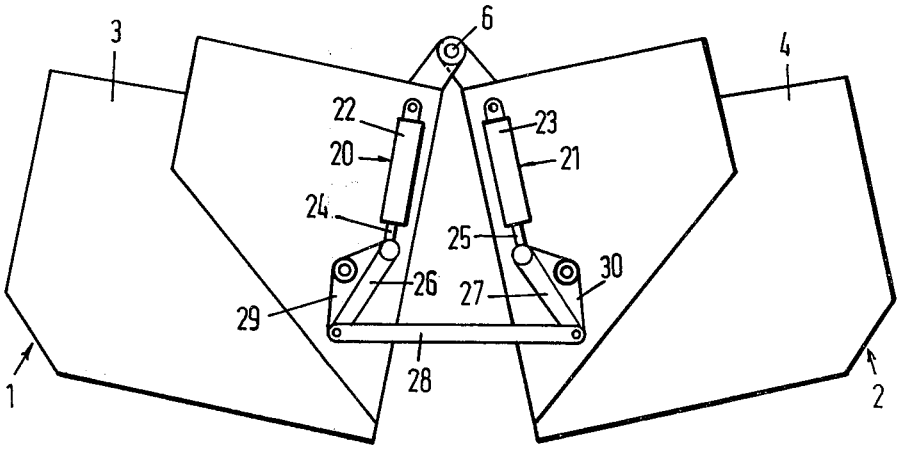

In FIGS. 3 and 4 the general ship construction is indicated by the same reference numerals as in FIGS. 1 and 2, consequently two ship halves 1 and 2 with air chambers 3 and 4, a well 5 and a hinge joint 6.

The construction shown in FIGS. 3 and 4 is provided with two jack means 20 and 21 comprising respectively two cylinders 22 and 23 and two piston rods 24 and 25. The bottom ends of the cylinders 22 and 23 are pivoted respectively to the ship halves 1 and 2, while the free ends of the piston rods 24 and 25 are pivoted respectively to a lever 26 and 27 at the one end thereof. The opposite ends of the levers 26 and 27 are pivoted to the ends of a connection rod 28, while on levers 26 and 27 there has been welded each time a triangular plate 29 respectively 30, the free angular point of which is each time pivotally coupled respectively to the ship half 1 and 2. Also this construction, as the one shown in FIGS. 1 and 2, is in mirror-symmetrical relationship relative to the median longitudinal plane of the vessel.

The parts employed in the two embodiments are substantially identical. However, the places where the various elements are pivotally connected to the triangular plate rod construction, which naturally also may consist of a single triangular plate, have been interchanged. Through this arrangement a preferred vertical arrangement of the deck means is achieved.

Figure 5:
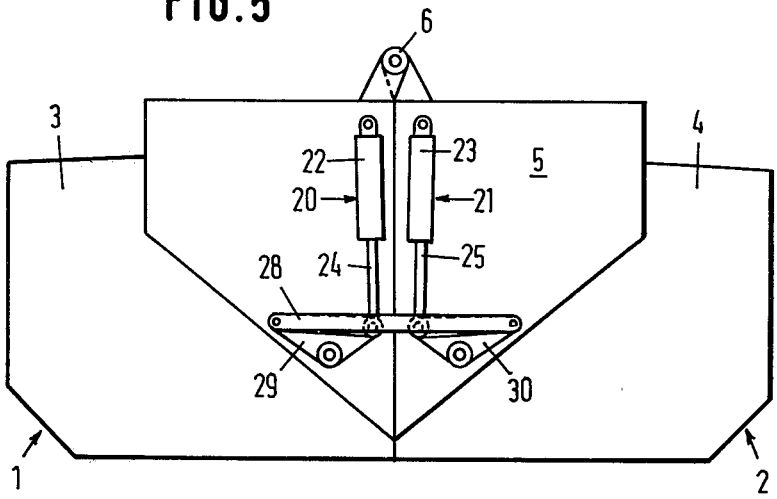
Figure 6:
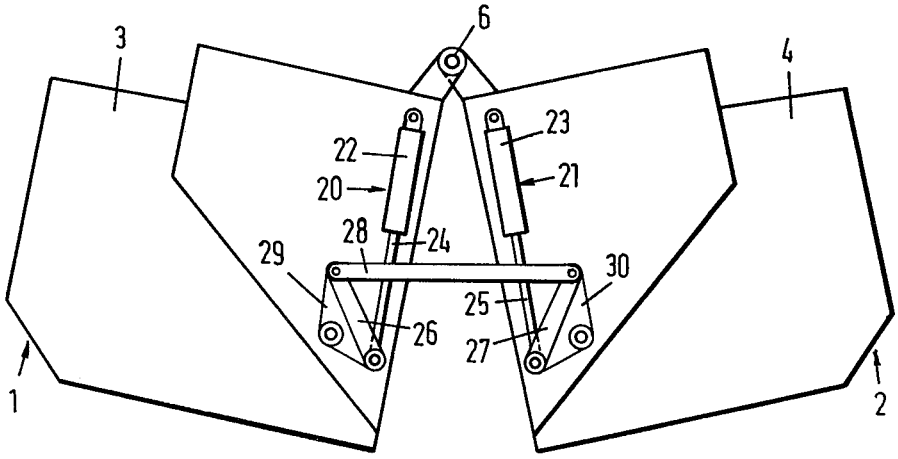
Figure 7:
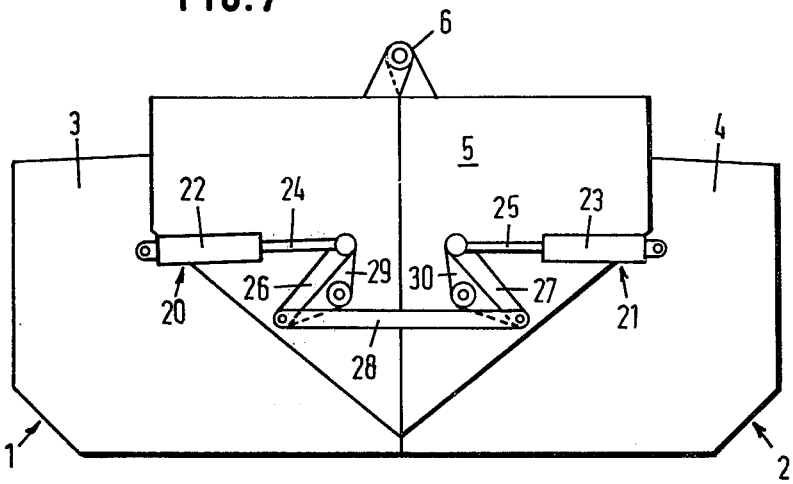
Figure 8:
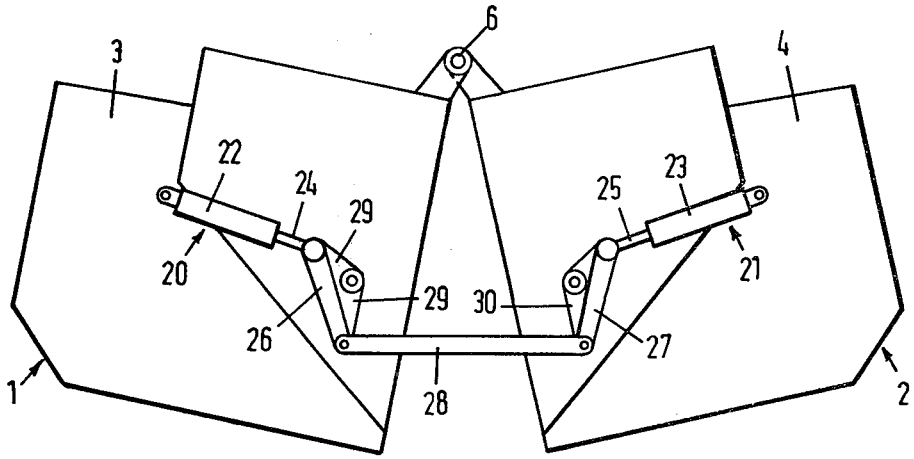

The hopper barge according to FIGS. 5 and 6 is provided with the same construction parts as that according to FIGS. 3 and 4, which parts therefore are indicated by the same reference numerals. Changed is the position of the triangular plate. This has been turned through 180° relative to an axis extending horizontally athwartships. This results in that during the closure of the vessel, whereby the greatest forces have to be provided by the jack means, these are operative as pull cylinders. Since in general pressure cylinders are preferred on account of their greater effective piston surface, the construction of FIGS. 3 and 4 will be the practically preferred embodiment.

Furthermore that likewise a horizontal arrangement of the jack means is possible may appear from FIGS. 7 and 8 wherein again the same construction parts are used as in the above discussed embodiments; reason why again the same reference numerals are used for indicating the various construction parts.

For a proper realization of the loading and the subsequent closure of the vessel, the respective pairs of jack means of each control unit should preferably perform a mutually identical displacement, or be controlled simultaneously and identically. In FIG. 9 such a control system is shown. The jack means to be controlled are indicated by 50 and 51 and comprise a cylinder 52, 53, a piston rod 54, 55 and a piston 56, 57. The fluid supply and discharge for the jack means 50 and 51 takes place via lines 58, 59, 60 and 61. The lines 58 and 59 connect the spaces 62, 63 disposed above the pistons 56, 57 to each time a pump-motor unit 64, 65, which likewise connects a pair of lines 66, 67. The lines 60 and 61 starting from piston rod spaces 68, 69 in the cylinders 52, 53 coincide with line 67 in one point and from there may be in communication with a reservoir 76 via a line 70, a control valve 71 and a line 72 with non-return valve 73 or a line 74 with main pump 75. The line 66 originating from the pump-motor unit 64 whose shaft 77 is likewise rotation axis for the pump-motor unit 65, may likewise be in communication with the reservoir 76 via the control valve 71 and the line 72 or 74. Whether and via which line said communication exists depends on the control valve 71 which may have three positions, one position 78 wherein both line 66 and 70 are not in communication with the reservoir 76; a position 79 wherein line 66 is connected via line 74 and line 70 via line 72 to the reservoir 76; and a position 80 wherein line 66 is connected via line 72 to the reservoir 76 and line 70 via line 74.

For protection purposes the system furthermore comprises controllable non-return valves (not shown) in the various lines adjacent the cylinders.

The operation of the control system is the following:

In case the piston rods 54 and 55 are to be moved from cylinders 52 and 53, consequently in FIG. 6 the pistons 56 and 57 to be moved downwardly, then the control valve 71 is to be pushed in position 79 and the main pump 75 could be started. From the reservoir 76 fluid will then be pressed into cylinder space 62 via lines 74 and 66, the pump-motor unit 64 and the line 58, which will move piston 56 downwards, whereby the fluid present in cylinder space 68 may escape via line 60. Since, however, fluid is pressed through the pump-motor unit 64, this will function as motor for the pump-motor unit 65 and operative as pump, so that the same quantity of fluid will be supplied to the cylinder space 63 via line 59 as to cylinder space 62, with the result that the pistons 56 and 57 will be displaced along identical distances. The fluid pumped by unit 65 to cylinder space 63 is drawn in via line 67 which receives its supply from lines 60 and 61, which in the present case are operative as discharge lines for cylinder spaces 68 and 69. The fluid originating from these spaces that is not taken over by line 67 flows to the reservoir 76 via line 70, control valve 71, non-return valve 73 and line 72. When the required extension of piston rods 54 and 55 is attained, the control valve 71 is brought in position 78 and the main pump 75 is switched off.

For retracting the piston rods 54 and 55, consequently the upward displacement of the pistons 56 and 57 seen in FIG. 9 it will be necessary besides the restarting of the main pump 75, to bring control valve 71 in the position 80. Via lines 60 and 61 fluid will be pressed in cylinder spaces 68 and 69. The fluid pressed from cylinder space 62 via line 58 will drive the pump-motor unit 64 in connection with the substantial pressure drop, which in its turn drives the pump-motor unit 65. The fluid flowing from the space 63 is directly pressed by the pump-motor unit in the supply system and ensures the synchronism of the piston 57.

The quantity of fluid to be handled by the main pump 75 in this control system is substantially identical to the quantity of fluid which has to be brought in one of the two cylinders. This quantity of fluid to be handled by the main pump 75 is consequently only half the quantity of fluid necessary for realizing the steering, so that we may speak of a quickly reacting system. This control system may become more effective and more well-balanced yet by using the improved control system shown in FIG. 10. As in the system according to FIG. 9, it comprises: jack means 50 and 51 with cylinders 52 and 53, piston rods 54 and 55, pistons 56 and 57 and cylinder spaces 62, 63, 68, 69, supply and discharge lines 58–61, a control valve 71 with positions 78–80, a line 72 with non-return valve 73, a line 74 with main pump 75, and a reservoir 76.

The line 58 bifurcates into a line 81, which terminates in line 60 via a pump-motor unit 82 and a line 83, which via a pump-motor unit 84 and a line 85 is connected to a line 86 communicating with control valve 71. The line 59 bifurcates similarly into a line 88 terminating via a motor-pump unit 87 in line 61 and a line 89 which connects to line 86 via a pump-motor unit 90 and a line 91. The lines 60 and 61 meet and communicate there with a line 92 extending towards the control valve 71. Furthermore the pump-motor units 82 and 90 are disposed on the same shaft 93 and the pump-motor units 84 and 87 on the same shaft 94.

The operation of the control system is the following:

In case the operative length of the jack means 50 and 51 is to be enlarged, or in FIG. 10 the pistons 56 and 57 are to be pressed downwards, the control valve 71 should be brought in position 80 and the main pump 75 should be switched on. The fluid is then pressed through line 86 through lines 85, 91, the motor-pump unit 84, 90, lines 83, 89 and lines 58, 59 as far as in the cylinder spaces 62 and 63. Thereby the pump-motor units 84 and 90 will drive the pump-motor unit 87 and 82 coupled therewith, so that the latter will draw in fluid via lines 61 and 60 from cylinder spaces 69 and 68 and pump same via lines 88, 59 and 81, 58 to the cylinder spaces 63 and 62. The part of the fluid that is not thus circulated, is discharged via line 92 to the reservoir 76.

In this control system it is ensured that both pistons 56 and 57 are exactly synchronized by the coupling of the supply path of the one jack means with the forced circulation circuit of the other jack means and vice versa.

The lifting of the pistons 56 and 57, thus reducing the operative length of the jack means, takes place during the bringing of the control valve 71 in position 79, whereby fluid is conducted via line 92 and subsequently lines 60 and 61 to the cylinder spaces 68 and 69, which results in the forcing out of fluid from the cylinder spaces 62 and 63. This fluid has the tendency of flowing away to the reservoir 76 from lines 58 and 59 via lines 83 and 89, the pump-motor units 84 and 90, lines 85 and 91 and line 86. However, since as a result of the through-flow of the pump-motor units 84 and 90 likewise the pump-motor units 87 and 82 are driven, a proportional part of the fluid originating from the cylinder spaces 62 and 63 will be circulated to the cylinder spaces 68 and 69. Through these clutches disposed in the discharge circuits it will again be ensured that the pistons 56 and 57 are displaced entirely synchronously.

It is observed that the steering systems shown in FIGS. 9 and 10 are particularly suitable for application to pressure cylinders in case pull cylinders are used, it is preferable to position the motor-pump units in the supply lines 60, 61 to the cylinder spaces 68, 69, or to rotate the jack means 50, 51 in the figures through 180°, so that the piston rods 54, 55 point in upward direction.

What I claim is:

1. A hopper barge comprising at least two longitudinal air chambers interconnected pivotally at deck level, which chambers in a loading position bound an upwardly open well and in a discharging position release a discharge opening disposed substantially at the bottom side, at least one control unit for controlling the relative position of the air chambers comprising two synchronously controlled jack means, each being pivotally connected at one end to one of the air chambers through a lever arm and connected at the other end to the same air chamber by a hinge fixed to that chamber, said lever arms being pivotally interconnected by a connection rod and being arranged in substantially mirror-symmetrical relationship relative to the median longitudinal plane of the barge.

2. A hopper barge according to claim 1, characterized in that the hinges of the jack means secured to the air chambers are disposed adjacent the hinge joint between the two air chambers.

3. A hopper barge according to claim 1 or 2, characterized in that both jack means extend substantially in vertical direction.

4. A hopper barge according to claim 1, characterized in that each lever is a substantially triangular element, each element being pivotally connected at two of its angles to the respective jack and the respective chamber, and pivotally connected at an intermediate angle to said connection rod.

5. A hopper barge according to claim 1, characterized in that the jack means are operated by a fluid and are controlled by a control provided with two hydraulic pump-motor units with directly coupled rotary shafts, whereby the one unit is incorporated in the flow path of the operating fluid of the one cylinder and the other unit in that of the other cylinder.

6. A hopper barge according to claim 1, characterized in that two pairs of mutually directly coupled pump-motor units are present, the first unit of the one pair being disposed in a forced circulation circuit of the first cylinder and the other in a supply-discharge path of the second cylinder, while the one unit of the other pair is disposed in a supply-discharge path of the first cylinder and the other in a forced circulation circuit of the second cylinder.

7. A hopper barge according to claim 6, characterized in that the pump-motor units in supply-discharge paths are provided in those lines wherein the operating pressure prevails during the bringing of the chambers to the loading position.

8. In a hopper barge: two longitudinal air chambers pivotally mounted for swinging movement about a common longitudinal axis between a down position in which they form a well having an open top at deck level and an up position in which they form a downwardly facing discharge opening; and means for swinging the chambers between their up and down positions, said means including a fluid-operated piston and cylinder unit associated with each chamber and disposed below deck level, a hinge connecting one end of each unit to the respective chamber for pivotal movement about an axis parallel to said common axis, a lever arm pivoted at one end to the other end of each unit, the other end of each lever arm being pivoted to the respective chamber, said lever arms being arranged in substantially mirror-symmetrical relationship relative to the median longitudinal plane of the barge, a rigid connecting rod interconnecting said lever arms intermediate their ends, and control means for controlling the action of said piston and cylinder units synchronously.

* * * * *